US010138639B2

(12) United States Patent
Moore et al.

(10) Patent No.: US 10,138,639 B2
(45) Date of Patent: Nov. 27, 2018

(54) MOLDING ASSEMBLY AND FLOOR INSTALLATION

(71) Applicant: Unilin North America LLC, Dallas, TX (US)

(72) Inventors: David Moore, Apex, NC (US); Marco Trevino, Wake Forest, NC (US); Marc W. Monson, High Point, NC (US)

(73) Assignee: Unilin North America LLC, Dallas, TX (US)

( * ) Notice: Subject to any disclaimer, the term of this patent is extended or adjusted under 35 U.S.C. 154(b) by 0 days.

(21) Appl. No.: 15/644,341

(22) Filed: Jul. 7, 2017

(65) Prior Publication Data

US 2018/0010346 A1 Jan. 11, 2018

Related U.S. Application Data

(60) Provisional application No. 62/360,712, filed on Jul. 11, 2016.

(51) Int. Cl.
*E04F 19/06* (2006.01)
*E04F 11/16* (2006.01)

(52) U.S. Cl.
CPC ..... *E04F 19/066* (2013.01); *E04F 11/163* (2013.01); *E04F 19/061* (2013.01); *E04F 19/063* (2013.01); *E04F 19/068* (2013.01)

(58) Field of Classification Search
CPC ..... E04F 19/061; E04F 19/063; E04F 19/065; E04F 19/066; E04F 19/068; E04F 15/02005; E04F 19/062; E04F 2201/0153; E04F 11/16; E04F 11/163; E04F 11/166; E04F 11/17
See application file for complete search history.

(56) References Cited

U.S. PATENT DOCUMENTS 3,339,329 A * 9/1967 Berg ..... E04D 3/366 52/395
3,667,177 A * 6/1972 Biela ..... A47K 3/008 4/252.1
3,688,460 A * 9/1972 Van Loghem ..... E04F 19/065 277/641
3,696,461 A * 10/1972 Kelly ..... A47G 27/045 16/16

(Continued)

FOREIGN PATENT DOCUMENTS

AT 007416 U1 3/2005
DE 29822236 U1 3/1999

(Continued)

*Primary Examiner* — Adriana Figueroa
*Assistant Examiner* — Jessie T Fonseca
(74) *Attorney, Agent, or Firm* — Jenkins, Wilson, Taylor & Hunt, P.A.

(57) ABSTRACT

Provided herein is a molding assembly for bridging a gap between floor covering materials, or for finishing an edge of a floor covering material. The molding assembly comprising a molding and a track is configured with a hinge portion to allow tilting of the molding when attached to the track attachment component. Floor installations are also provided herein. The floor installations comprise floor covering materials adjoining respective sides of a gap, and a molding assembly to cover the gap and accommodate any difference in thickness between the respective adjoining floor covering materials.

15 Claims, 5 Drawing Sheets

(56) References Cited

U.S. PATENT DOCUMENTS

| | | | | |
|---|---|---|---|---|
| 4,067,155 | A * | 1/1978 | Ruff | E04B 1/6803 4/498 |
| 5,657,598 | A * | 8/1997 | Wilbs | A47G 27/045 403/122 |
| 6,158,915 | A * | 12/2000 | Kise | E04D 13/1606 403/2 |
| 6,357,192 | B1 | 3/2002 | Schlüter | |
| 6,729,092 | B2 | 5/2004 | Grosjean | |
| 7,409,802 | B2 * | 8/2008 | Fiedler | E04D 1/365 52/287.1 |
| 7,797,900 | B2 * | 9/2010 | Sondermann | E04F 19/062 52/287.1 |
| 8,161,708 | B2 * | 4/2012 | Schacht | E04F 15/02005 52/211 |
| 8,572,919 | B1 * | 11/2013 | Neill | E04F 19/061 52/466 |
| 8,966,847 | B2 * | 3/2015 | Kessler | E04B 1/6804 52/395 |
| 9,610,880 | B2 * | 4/2017 | Masanek, Jr. | B60N 3/046 |
| 2001/0005539 | A1 * | 6/2001 | Neuhofer, Jr. | E04F 19/062 428/122 |
| 2003/0084634 | A1 * | 5/2003 | Stanchfield | E04F 15/02005 52/464 |
| 2006/0207198 | A1 | 9/2006 | Sondermann | |
| 2009/0120262 | A1 * | 5/2009 | Proot | B26B 29/06 83/697 |
| 2013/0061548 | A1 * | 3/2013 | Plenet | E04F 19/063 52/466 |

FOREIGN PATENT DOCUMENTS

| | | | | |
|---|---|---|---|---|
| DE | 202005004624 | U1 | 7/2005 | |
| EP | 1203856 | A1 | 5/2002 | |
| EP | 2141304 | A1 | 1/2010 | |
| FR | 2873140 | A1 * | 1/2006 | E04F 19/061 |
| GB | 2247619 | A | 3/1992 | |
| WO | WO-2005042875 | A1 * | 5/2005 | A47G 27/045 |
| WO | WO 2005/083195 | A1 | 9/2005 | |
| WO | WO 2014/128609 | A1 | 8/2014 | |

* cited by examiner

MOLDING ASSEMBLY AND FLOOR INSTALLATION

CROSS-REFERENCE TO RELATED APPLICATION

This patent application claims priority to U.S. Provisional Patent Application Ser. No. 62/360,712, filed Jul. 11, 2016, the entire content of which is incorporated by reference herein.

TECHNICAL FIELD

The subject matter disclosed herein is directed to a molding assembly and floor installation.

BACKGROUND

The presently disclosed subject matter is directed to molding assemblies for the finishing of floor covering materials, such as for example luxury vinyl tile (LVT) flooring and/or floating panel floorings comparable to laminate flooring.

LVT flooring comprises resilient flooring panels or sheets which may either be glued to the underground or be clicked together glueless to form a floating floor covering. Such flooring is usually thin, i.e. 5 mm or less.

Whatever the type of flooring, there are often transitions between different flooring types or expansion gaps, either of which must be finished or covered after flooring installation.

Existing molding assemblies are disclosed in PCT Patent Application Publication Nos. WO 2014/128609 and WO 2005/083195; U.S. Pat. No. 6,357,192; European Patent Nos. EP 2 141 304, EP 1 203 856 and GB 2247619. Such existing moldings, however, are overly complex and make use of additional elements, such as torsion springs. Moreover, such existing moldings can be difficult to mount or dismount.

The present disclosure solves the need for molding assemblies that allow for a more universal finishing of transitions and gaps, without undue complexity. The disclosed moldings, assemblies and flooring installations are configured to cover gaps between floorings and finish flooring edges across various heights and differences in elevation.

SUMMARY

This summary lists several embodiments of the presently disclosed subject matter, and in many cases lists variations and permutations of these embodiments. This summary provides examples without limitation of the numerous and varied embodiments. Mention of one or more representative features of a given embodiment is likewise also provided as an example. Such an embodiment can typically exist with or without the feature(s) mentioned; likewise, those features can be applied to other embodiments of the presently disclosed subject matter, whether listed in this summary or not. To avoid excessive repetition, this summary does not list or suggest all possible combinations of such features.

Provided herein is a molding assembly for bridging a gap between floor covering materials, the molding assembly comprising a molding and a track, wherein the track comprises a track attachment component configured to releasably attach the molding to the track, wherein the track attachment component comprises a single upwardly protruding leg connected to the track by a hinge portion, wherein the hinge portion is configured to allow tilting of the molding when attached to the track attachment component, wherein the hinge portion and track are a single unitary piece made of the same material.

Also provided herein is a floor installation, the floor installation comprising floor covering materials adjoining respective sides of a gap, wherein the floor covering materials on each side of the gap differ in thickness by at least 1 millimeter, and a molding assembly, wherein the molding assembly comprises a molding and a track, wherein the track comprises a track attachment component configured to releasably attach the molding to the track, wherein the track attachment component comprises a single upwardly protruding leg connected to the track by a hinge portion, wherein the hinge portion is configured to allow tilting of the molding when attached to the track attachment component, wherein the hinge portion and track are a single unitary piece made of the same material, wherein the track of the molding assembly is installed in the gap between the floor covering materials, wherein the molding is attached to the track by the upwardly protruding leg of the track, wherein the molding is tilted by the hinge portion, wherein the molding covers the gap and touches or contacts both adjoining floor covering materials, thereby bridging the difference in thickness between the respective adjoining floor covering materials.

Also provided herein is a floor installation, the floor installation comprising floor covering material and a molding assembly, wherein the molding assembly comprises a molding and a track, wherein the track comprises a track attachment component configured to releasably attach the molding to the track, wherein the track attachment component comprises a single upwardly protruding leg connected to the track by a hinge portion, wherein the hinge portion is configured to allow tilting of the molding when attached to the track attachment component, wherein the hinge portion and track are a single unitary piece made of the same material, wherein the track of the molding assembly is installed at an edge of the floor covering material, wherein the molding is attached to the track by the upwardly protruding leg of the track, wherein the molding is tilted by the hinge portion, and wherein the molding provides a finishing edge for the floor covering material.

Objects of the presently disclosed subject matter having been stated above, other objects and advantages of the presently disclosed subject matter will become apparent to those skilled in the art after a study of the following description and drawings.

BRIEF DESCRIPTION OF THE DRAWINGS

The presently disclosed subject matter can be better understood by referring to the following figures. The components in the figures are not necessarily to scale, emphasis instead being placed upon illustrating the principles of the presently disclosed subject matter (often schematically). In the figures, like reference numerals designate corresponding parts throughout the different views. A further understanding of the presently disclosed subject matter can be obtained by reference to an embodiment set forth in the illustrations of the accompanying drawings. Although the disclosure herein provides examples of systems for carrying out the presently disclosed subject matter, both the organization and method of operation of the presently disclosed subject matter, in general, together with further objectives and advantages thereof, may be more easily understood by reference to the drawings and the following description. The drawings are not intended to limit the scope of this presently disclosed subject matter, which is set forth with particularity in the claims as appended or as subsequently amended, but merely to clarify and exemplify the presently disclosed subject matter.

For a more complete understanding of the presently disclosed subject matter, reference is now made to the following drawings in which.

DETAILED DESCRIPTION

Figure 1A:
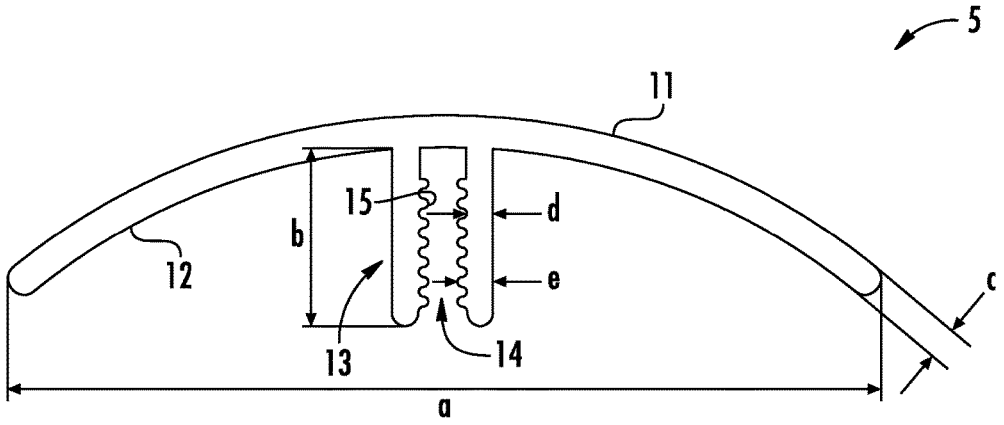
FIGS. 1A and 1B are side views of a molding and track, respectively, of a molding assembly as disclosed herein.

The presently disclosed subject matter now will be described more fully hereinafter, in which some, but not all embodiments of the presently disclosed subject matter are described. Indeed, the presently disclosed subject matter can be embodied in many different forms and should not be construed as limited to the embodiments set forth herein; rather, these embodiments are provided so that this disclosure will satisfy applicable legal requirements.

The terminology used herein is for the purpose of describing particular embodiments only and is not intended to be limiting of the presently disclosed subject matter.

While the following terms are believed to be well understood by one of ordinary skill in the art, the following definitions are set forth to facilitate explanation of the presently disclosed subject matter.

All technical and scientific terms used herein, unless otherwise defined below, are intended to have the same meaning as commonly understood by one of ordinary skill in the art. References to techniques employed herein are intended to refer to the techniques as commonly understood in the art, including variations on those techniques or substitutions of equivalent techniques that would be apparent to one of skill in the art. While the following terms are believed to be well understood by one of ordinary skill in the art, the following definitions are set forth to facilitate explanation of the presently disclosed subject matter.

In describing the subject matter herein, it will be understood that a number of techniques and steps are disclosed. Each of these has individual benefit and each can also be used in conjunction with one or more, or in some cases all, of the other disclosed techniques.

Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Following long-standing patent law convention, the terms "a", "an", and "the" refer to "one or more" when used in this application, including the claims. Thus, for example, reference to "a panel" includes a plurality of such panels, and so forth.

Unless otherwise indicated, all numbers expressing quantities of ingredients, reaction conditions, and so forth used in the specification and claims are to be understood as being modified in all instances by the term "about". Accordingly, unless indicated to the contrary, the numerical parameters set forth in this specification and attached claims are approximations that can vary depending upon the desired properties sought to be obtained by the presently disclosed subject matter.

As used herein, the term "about" when referring to a value or to an amount is meant to encompass variations of in some embodiments ±20%, in some embodiments ±10%, in some embodiments ±5%, in some embodiments ±1%, in some embodiments ±0.5%, and in some embodiments ±0.1% from the specified amount.

The term "comprising", which is synonymous with "including" "containing" or "characterized by" is inclusive or open-ended and does not exclude additional, unrecited elements or method steps. "Comprising" is a term of art used in claim language which means that the named elements are essential, but other elements can be added and still form a construct within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter.

With respect to the terms "comprising", "consisting of", and "consisting essentially of", where one of these three terms is used herein, the presently disclosed and claimed subject matter can include the use of either of the other two terms.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

A molding assembly is disclosed for bridging a gap between floor covering materials or for finishing the border of a floor covering material. In some embodiments such a molding assembly comprises a molding and a track. The track can in some embodiments comprise a track attachment component configured to releasably attach the molding to the track. The track attachment component can in some embodiments comprise a single upwardly protruding leg connected to the track by a hinge portion, which can be configured to allow tilting of the molding when the molding is attached to the track attachment component. Moreover, in some aspects the hinge portion and track are a single unitary piece made of the same material.

The molding portion of the molding assembly can in some embodiments comprise a transition profile comprising a convex upper surface and a bottom surface having an attachment component. The attachment component on the molding can be configured to cooperate with the upwardly protruding leg of the track attachment component such that the two can be joined. For example, the upwardly protruding leg of the track attachment component can be inserted into the groove to allow the molding and the track to become mutually releasably attached to one another.

Also provided herein is a floor installation comprising floor covering materials with a gap between two or more floor covering pieces, and a molding assembly as disclosed herein to bridge the gap. In some embodiments the floor covering materials on each side of the gap can differ in thickness by at least 1 millimeter, and the molding assembly can cover the gap and simultaneously compensate for the difference in thickness in the flooring materials on each side of the gap. For example, the track of the molding assembly can be installed in the gap between the floor covering materials, wherein the molding is attached to the track by the upwardly protruding leg of the track. The molding can be tilted by the hinge portion thereby allowing the molding to cover the gap and touch both adjoining floor covering materials despite their difference in thickness.

Furthermore, provided herein is a floor installation for finishing an edge of a flooring material, comprising a floor covering material, and a molding assembly. The molding assembly can comprise a molding and a track. The track can in some aspects comprise a track attachment component configured to releasably attach the molding to the track, wherein the track attachment component comprises a single upwardly protruding leg connected to the track by a hinge portion, wherein the hinge portion is configured to allow tilting of the molding when attached to the track attachment component. In some aspects the hinge portion and track are a single unitary piece made of the same material. The track of the molding assembly can be installed at an edge of the floor covering material, wherein the molding is attached to the track by the upwardly protruding leg of the track, wherein the molding is tilted by the hinge portion, and wherein the molding provides a finishing edge for the floor covering material.

FIG. 1A is a side view of a molding 5 as disclosed herein. Molding 5 can in some embodiments be a transition profile comprising a convex upper surface 11 and a bottom surface 12 having molding attachment component 13. In some embodiments bottom surface 12 comprises a concave surface. Molding attachment component 13 can comprise a groove 14 formed by two parallel members, wherein molding attachment component 13 extends substantially perpendicular from bottom surface 12 of molding 5. In some embodiments molding attachment component 13 of molding 5 comprises a barbed inner surface 15, comprising barbs, ribs, ridges, threads or any other structure or texture configured to provide a gripping or friction on a member (e.g. a leg as discussed below) inserted within groove 14.

In some embodiments molding 5 can have a width a of about 1.750 inches, or about 1.0 to about 3.0 inches, and a height b (or a height of attachment component 13) of about 0.365 inches, or about 0.1 to abut 0.9 inches. The thickness c of molding 5, or the thickness between upper surface 11 and lower surface 12, can be about 0.072 inches, or about 0.01 to about 0.15 inches. Thickness d of molding attachment component 13 on each side of groove 14 can be about 0.030 inches, or about 0.01 to about 0.060 inches, where no barb 15 is present, with a thickness e of about 0.066 inches, or about 0.020 to about 0.090 inches, where a barb 15 is present.

Figure 1B:
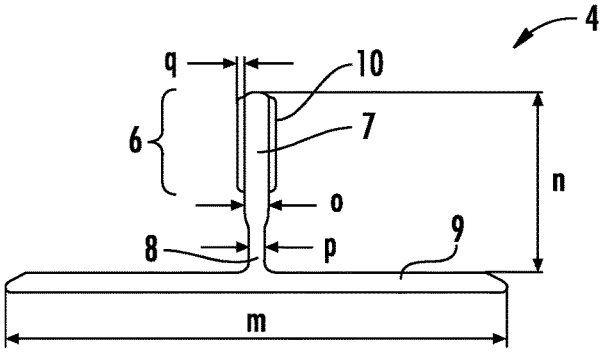

FIG. 1B is a side view of a track 4 as disclosed herein. Track 4 can in some embodiments comprise a track attachment component 6 extending from a base portion 9. Base portion 9 can comprise a substantially planar structure configured to rest upon and/attach to a floor substrate, with track attachment component 6 comprising a single upwardly protruding leg 7. Leg 7 can be connected to base portion 9 by hinge portion 8. Together hinge portion 8 and leg 7 can comprise a substantially vertical structure extending substantially perpendicular from the substantially planar and horizontal base portion 9. In some embodiments base portion 9, hinge portion 8 and leg 7 can comprise a single unitary piece and be made from the same or substantially the same material.

In some embodiments upwardly protruding leg 7 is configured to releasably attach molding 5 to track 4 by insertion into groove 14 of molding 5. When attached to track 4 molding 5 can articulate or flex laterally due to the hinge action or flexibility of hinge portion 8. In some aspects upwardly protruding leg 7 comprises a separate surface portion 10 configured to provide friction interlocking or mechanical interlocking with groove 14 of attachment component 13 of molding 5. In some aspects separate surface portion 10 can comprise a barbed surface to engage or interact with barbs 15 of groove 14. Alternatively, or in addition, separate surface portion 10 can comprise a material more compressible than the material from which the remainder of track 4 is made.

As illustrated in FIG. 1B, track 4 can have a base portion 9 width m of about 0.2 to about 2.0 inches, and a leg 7 height n of about 0.365 inches, or about 0.150 to about 0.70 inches. Leg 7 width o can be about 0.050 inches, or about 0.025 to about 0.10 inches, with a hinge portion 8 having a width p of about 0.030 inches, or about 0.010 to about 0.060 inches. Separate surface portion 10 can have a thickness q of about 0.015 inches, or about 0.005 to about 0.040 inches.

In some embodiments track 4 can comprise an extruded profile, and can in some aspects be made from any suitable material, including for example but not limited to, polyvinyl chloride (PVC), polypropylene (PP), polyethylene (PE), polyethylene terephthalate (PET), and/or combinations thereof. In some embodiments molding 5 can comprise an aluminum or plastic material, or any suitable material for a flooring joint, transition profile, border, molding or finishing component.

In some embodiments there is a floor installation, as depicted, for example, in FIGS. 2A, 2B, 3A, 3B and 4. Such a floor installation can comprise two or more adjoining floor covering materials forming a gap therebetween. In some embodiments these flooring materials can be the same material, or can be different flooring materials, e.g. at a transition zone. In some embodiments the thickness of the adjoining flooring materials with a gap therebetween can be of differing thicknesses, or can be of the same or similar thickness. For example, flooring materials at respective sides of a gap can differ in thickness by at least 1 millimeter (mm), or from about 1 mm to about 10 mm.

In the flooring installations provided herein, a molding assembly, as disclosed herein, can be provided to bridge the gap between the adjoining flooring materials. As shown in FIGS. 2A, 2B, 3A, 3B and 4, a molding assembly 20, comprising a track 4 and molding 5, can bridge a gap 1 between two floor covering materials 2/3.

Figure 2A:
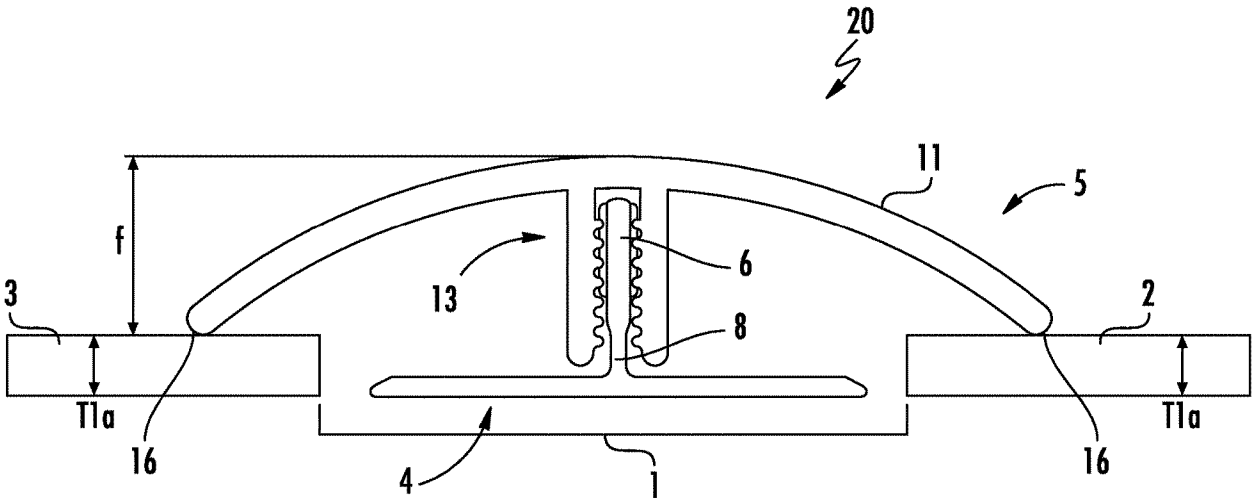
FIGS. 2A and 2B are side views of embodiments of flooring installations as disclosed herein.

In one embodiment shown in FIG. 2A, a side view of a schematic of an example molding assembly 20 is shown, with track 4 and molding 5 cooperating to bridge gap 1 between floor covering material 2 and floor covering material 3. Track attachment component 6 and molding attachment component 13 releasably attach by track attachment component 6 slidingly engaging molding attachment component 13.

Floor covering material 2 and floor covering material 3 can either be the same material or differing materials. As shown in FIG. 2A, floor covering material 2 and floor covering material 3 are the same or substantially the same height/thickness T1*a*. Thickness T1*a* can be about 0.118 inches (or 3 mm), or can range from about 0.05 to about 0.30 inches. By securely engaging track attachment component 6 of track 4, molding 5 completely covers gap 1 such that both lateral extremities 16 of molding 5 contact or touch floor covering materials 2/3. When molding 5 is depressed down on and engaged to track 4 the molding covers gap 1 and due to convex upper surface 11 has a height f above floor covering materials 2/3 of about 0.377 inches, or about 0.10 to about 0.50 inches.

Figure 2B:
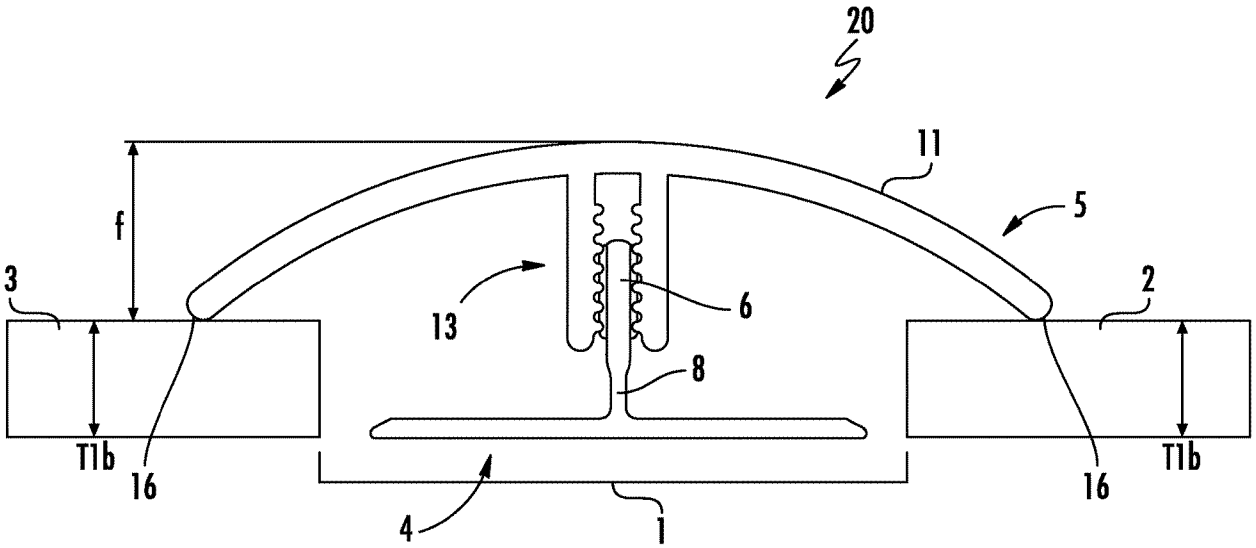

FIG. 2B is a side view of molding assembly 20 as shown in FIG. 2A, but applied to floor covering materials 2/3 of a greater thickness. As in FIG. 2A, molding assembly 20 of FIG. 2B comprises track 4 and molding 5 cooperating to bridge gap 1 between floor covering material 2 and floor covering material 3. Track attachment component 6 and molding attachment component 13 releasably attach by track attachment component 6 slidingly engaging molding attachment component 13.

Floor covering material 2 and floor covering material 3 can either be the same material or differing materials. As shown in FIG. 2B floor covering material 2 and floor covering material 3 are the same or substantially the same height/thickness T1*b*. Thickness T1*b* can be about 0.236 inches (or 6 mm), or can range from about 0.10 to about 0.50 inches. By securely engaging track attachment component 6 of track 4, molding 5 completely covers gap 1 such that both lateral extremities 16 of molding 5 contact or touch floor covering materials 2/3. When molding 5 is depressed down on and engaged to track 4 the molding covers gap 1 and due to convex upper surface 11 has a height f above flooring materials 2/3 of about 0.377 inches, or about 0.10 to about 0.50 inches.

FIGS. 2A and 2B illustrate that molding assembly 20 can bridge or cover a gap 1 between two flooring materials where the thickness of the flooring materials can range from relatively thin to relatively thick without affecting the function of the molding assembly 20. Whether applied to thin or thick flooring materials molding attachment component 13 of molding 5 is configured to engage track attachment component 6 of track 4 to securely hold molding 5 to cover gap 1.

Figure 3A:
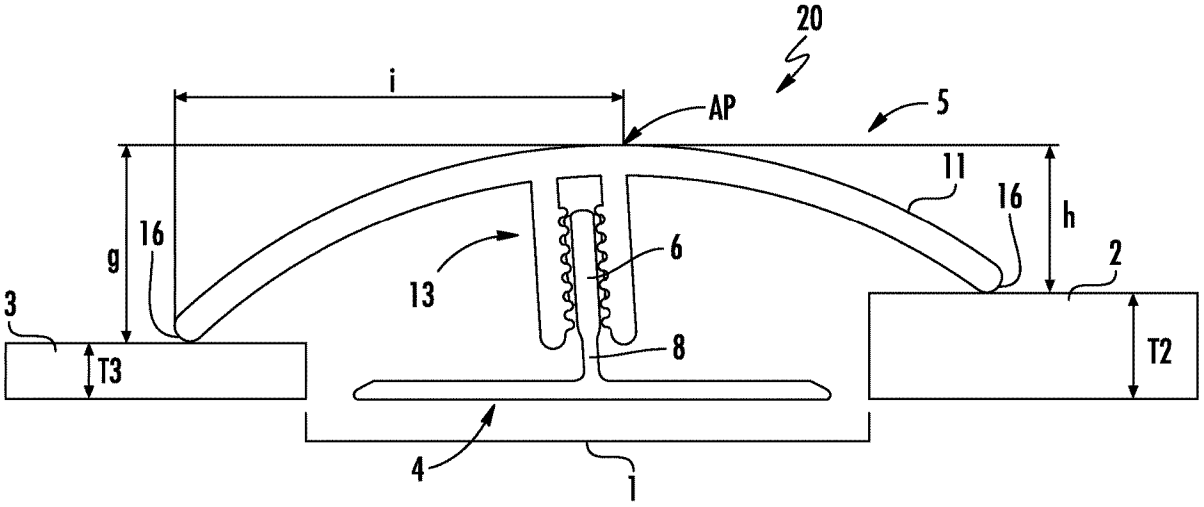
FIGS. 3A and 3B are side views of embodiments of flooring installations as disclosed herein.
Figure 3B:
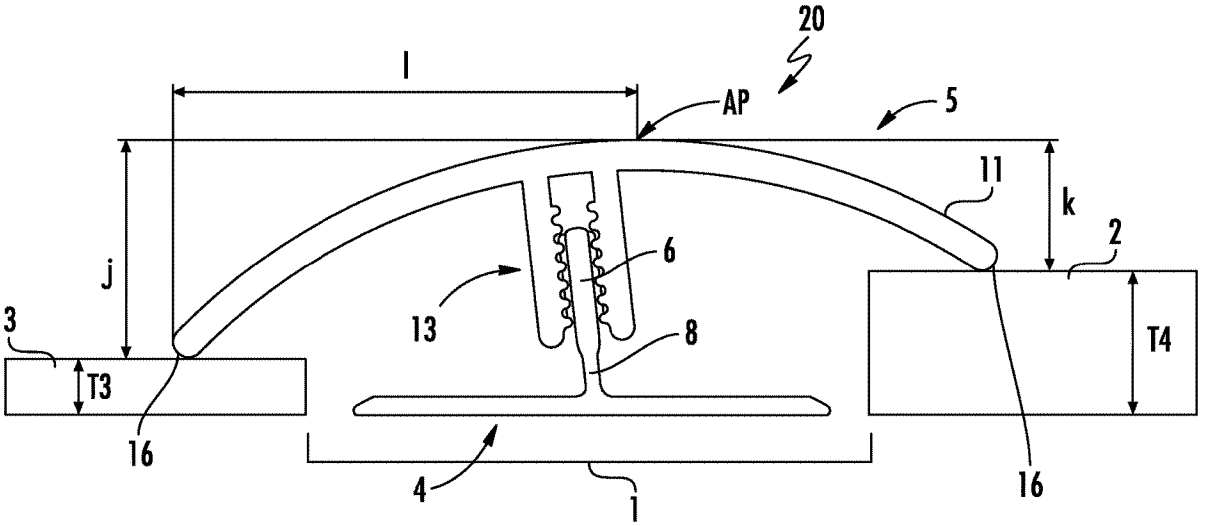

Turning now to FIGS. 3A and 3B, these side views of molding assembly 20 illustrate the use of molding assembly 20 to cover gap 1 between floor covering materials 2/3 of differing thicknesses. That is, one floor covering material on one side of the gap can have a different thickness than the other flooring material on the other side of the gap, yet still be covered by the disclosed molding assembly.

As shown in FIGS. 3A and 3B, molding assembly 20 of FIG. 2B comprises track 4 and molding 5 cooperating to bridge gap 1 between floor covering material 2 and floor covering material 3. Track attachment component 6 and molding attachment component 13 releasably attach by track attachment component 6 slidingly engaging molding attachment component 13. Hinge portion 8 of track attachment component 6 is configured to allow tilting of the molding when applied over gap 1 between floor covering materials 2/3 of varying thicknesses. By securely engaging track attachment component 6 of track 4, molding 5 completely covers gap 1 such that both lateral extremities 16 of molding 5 contact or touch adjoining floor covering materials 2/3, with hinge portion 8 allowing molding 5 to tilt to accommodate for the difference in thickness between floor covering material 2 and floor covering material 3.

In FIG. 3A floor covering material 2 and floor covering material 3 have different thicknesses. Floor covering material 2 has a thickness T2 of about 0.236 inches (or 6 mm), which can range from about 0.10 to about 0.50 inches, while floor covering material 3 has a thickness T3 of about 0.118 inches (or 3 mm), or can range from about 0.05 to about 0.30 inches.

Similar to FIG. 3A, but with a greater difference, floor covering material 2 and floor covering material 3 also have different thicknesses in FIG. 3B. In FIG. 3B floor covering material 2 has a thickness T4 of about 0.315 inches (or 8 mm), which can range from about 0.20 to about 0.60 inches, while floor covering material 3 has a thickness T3 of about 0.118 inches (or 3 mm), or can range from about 0.05 to about 0.30 inches.

By tilting molding 5 slightly to accommodate for the difference in floor thickness on each side of the gap, the apex AP, or highest point of upper surface 11 correspondingly shifts slightly from center. As illustrated in the comparison of FIGS. 3A and 3B, as the difference in thickness of floor covering material 2 and floor covering material 3 increases, so to does the degree to which molding 5 tilts and alters the relative dimensions also increases. For example, in FIG. 3A the distance i from the lateral extremity 16 contacting floor covering material 3 to apex AP is about 0.943 inches, whereas in FIG. 3B the distance I from the lateral extremity 16 contacting floor covering material 3 to apex AP is about 0.987 inches, as a result of the greater degree of tilt in FIG. 3B due to the greater difference in thickness of the flooring materials therein. Correspondingly, height g from floor covering material 3 to apex AP in FIG. 3A is about 0.439 inches, whereas height j from floor covering material 3 to apex AP in FIG. 3B is about 0.483 inches. Similarly, height h from floor covering material 2 to apex AP in FIG. 3A is about 0.321 inches, whereas height k from floor covering material 2 to apex AP in FIG. 3B is about 0.286 inches.

Figure 4:
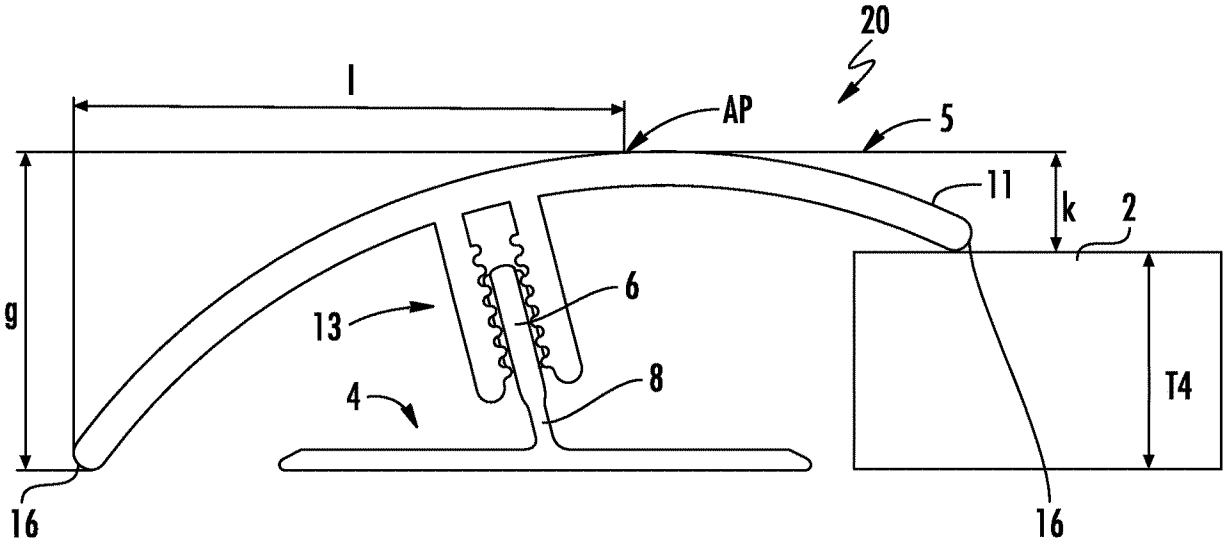
FIG. 4 is a side view of an embodiment of a flooring installation as disclosed herein.

As illustrated in FIG. 4, in some embodiments molding assembly 20 can be configured to finish a border of a floor covering. That is, instead of covering a gap between to floor boards or flooring materials as in FIGS. 2A, 2B, 3A and/or 3B, molding assembly 20 can also be a transition profile or finish molding to create a finished edge on a floor board or flooring material. Such is illustrated by the profile view of molding assembly 20 in FIG. 4.

As shown in FIG. 4, molding assembly 20 comprises track 4 and molding 5 cooperating finish an edge of floor covering material 2. Track attachment component 6 and molding attachment component 13 releasably attach by track attachment component 6 slidingly engaging molding attachment component 13. Hinge portion 8 of track attachment component 6 is configured to allow tilting of the molding when applied at the edge of floor covering material 2. By securely engaging track attachment component 6 of track 4, molding 5 provides a rounded and/or contoured surface over the edge of floor covering material 2 to improve the finished look and provide a more functional transition.

Molding assembly 20 can be configured to finish a border of a floor covering as illustrated in FIG. 4, for any thickness of flooring material. In FIG. 4 floor covering material 2 has a thickness T4, which can range from about 0.118 inches (or 3 mm) to about 0.315 inches (or 8 mm), or more. No matter the thickness of the floor covering material, hinge portion 8 of track attachment component 6 is configured to allow tilting of the molding when applied at the edge of floor covering material 2. By tilting molding 5 slightly to accommodate for the height or thickness T4 of floor covering material 2, the apex AP, or highest point of upper surface 11 correspondingly shifts slightly from center thereby increasing the length I. Moreover, as the thickness of floor covering material 2 increases, the degree to which molding 5 tilts increases, with a corresponding increase in height g and decrease in height k, as shown in FIG. 4.

Figure 5:
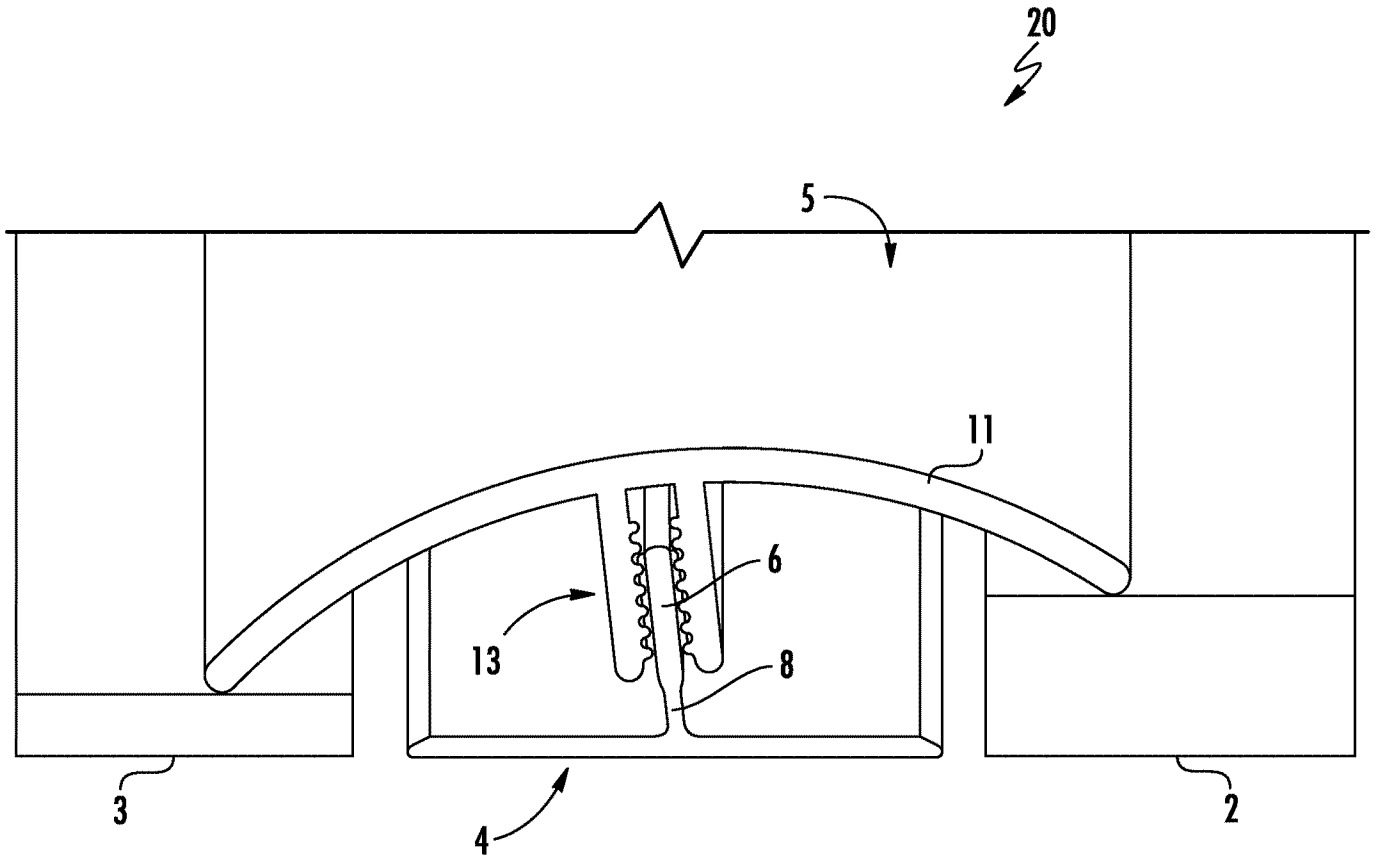
FIG. 5 is a perspective end view of an embodiment of a flooring installation as disclosed herein.

FIG. 5 is a perspective end view of a molding assembly 20 bridging a gap between two flooring elements 2/3. As illustrated in FIG. 5, molding assembly 20 comprises track 4 and molding 5 cooperating to bridge a gap between floor covering material 2 and floor covering material 3. Track attachment component 6 and molding attachment component 13 releasably attach by track attachment component 6 slidingly engaging molding attachment component 13. Hinge portion 8 of track attachment component 6 is configured to allow tilting of the molding when applied over the gap between floor covering materials 2/3 of varying thicknesses. By securely engaging track attachment component 6 of track 4, molding 5 completely covers the gap such that molding 5 contacts or touches both adjoining floor covering materials 2/3, with hinge portion 8 allowing molding 5 to tilt to accommodate for the difference in thickness between floor covering material 2 and floor covering material 3.

The dimensions shown in the figures and discussed herein are only exemplary and not intended to be limiting. For example, the thicknesses of the floor covering materials in FIGS. 2A, 2B, 3A, 3B and 4, and the dimensions of the molding assemblies, are solely for illustration only, with the disclosed molding assemblies usable with any variation or combination of flooring thicknesses consistent with the instant disclosure.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A molding assembly for bridging a gap between floor covering materials, the molding assembly comprising:

a molding; and a track, wherein the track comprises a track attachment component configured to releasably attach the molding to the track, wherein the track attachment component comprises a single upwardly protruding leg connected to the track by a hinge portion, wherein the upwardly protruding leg comprises a separate surface portion configured to provide friction interlocking or mechanical interlocking with the molding, wherein the separate surface portion is made from a material more compressible than a material from which the hinge portion and track are made, wherein the hinge portion is configured to allow tilting of the molding when attached to the track attachment component, wherein the hinge portion and track are a single unitary piece made of a same material, whereas the separate surface portion is made of a different material.

2. The molding assembly of claim 1, wherein the separate surface portion comprises a barbed surface.

3. The molding assembly of claim 1, wherein the track comprises an extruded profile.

4. The molding assembly of claim 1, wherein the molding is a transition profile comprising a convex upper surface and a bottom surface having a molding attachment component configured to cooperate with the upwardly protruding leg of the track attachment component.

5. The molding assembly of claim 4, wherein the molding attachment component comprises a groove, wherein the upwardly protruding leg of the track attachment component is insertable into the groove to allow the molding and the track to become mutually releasably attached to one another.

6. The molding assembly of claim 5, wherein the groove comprises a barbed inner surface.

7. The molding assembly of claim 1, wherein the material from which the track is made is selected from the group consisting of polyvinyl chloride (PVC), polypropylene (PP), polyethylene (PE) and polyethylene terephthalate (PET).

8. The molding assembly of claim 1, wherein the molding comprises an aluminum or plastic material.

9. The molding assembly of claim 1, wherein the molding assembly is configured to finish a border of a floor covering.

10. A floor installation, the floor installation comprising:

floor covering materials adjoining respective sides of a gap, wherein the floor covering materials on each side of the gap have a difference in thickness of at least 1 millimeter; and a molding assembly, wherein the molding assembly comprises:

a molding; and a track, wherein the track comprises a track attachment component configured to releasably attach the molding to the track, wherein the track attachment component comprises a single upwardly protruding leg connected to the track by a hinge portion, wherein the upwardly protruding leg comprises a separate surface portion configured to provide friction interlocking or mechanical interlocking with the molding, wherein the separate surface portion is made from a material more compressible than a material from which the hinge portion and track are made, wherein the hinge portion is configured to allow tilting of the molding when attached to the track attachment component, wherein the hinge portion and track are a single unitary piece made of a same material, whereas the separate surface portion is made of a different material;

wherein the track of the molding assembly is installed in the gap between the floor covering materials, wherein the molding is attached to the track by the upwardly protruding leg of the track, wherein the molding is tilted by the hinge portion, wherein the molding covers the gap and touches both adjoining floor covering materials, thereby bridging the difference in thickness between the respective adjoining floor covering materials.

11. The floor installation of claim 10, wherein the touching takes place at opposing lateral extremities of the molding.

12. The floor installation of claim 10, wherein the separate surface portion comprises a barbed surface.

13. A floor installation, the floor installation comprising:

floor covering material; and a molding assembly, wherein the molding assembly comprises:

a molding; and a track, wherein the track comprises a track attachment component configured to releasably attach the molding to the track, wherein the track attachment component comprises a single upwardly protruding leg connected to the track by a hinge portion, wherein the upwardly protruding leg comprises a separate surface portion configured to provide friction interlocking or mechanical interlocking with the molding, wherein the separate surface portion is made from a material more compressible than a material from which the hinge portion and track are made, wherein the hinge portion is configured to allow tilting of the molding when attached to the track attachment component, wherein the hinge portion and track are a single unitary piece made of a same material, whereas the separate surface portion is made of a different material;

wherein the track of the molding assembly is installed at an edge of the floor covering material, wherein the molding is attached to the track by the upwardly protruding leg of the track, wherein the molding is tilted by the hinge portion, wherein the molding provides a finishing edge for the floor covering material.

14. The floor installation of claim 13, wherein the separate surface portion comprises a barbed surface.

15. The floor installation of claim 13, wherein the track comprises an extruded profile.

* * * * *